US008080513B2

(12) United States Patent
McGinnis et al.

(10) Patent No.: US 8,080,513 B2
(45) Date of Patent: Dec. 20, 2011

(54) METHOD OF SHIPPING AND PREPARING LAUNDRY ACTIVES

(75) Inventors: Jerry Keith McGinnis, West Chester, OH (US); Alessandro Corona, III, Mason, OH (US); Darren Franklin King, West Chester, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 454 days.

(21) Appl. No.: 12/008,534

(22) Filed: Jan. 11, 2008

(65) Prior Publication Data

US 2009/0181877 A1 Jul. 16, 2009

(51) Int. Cl.
*C11D 3/00* (2006.01)
*C11D 17/06* (2006.01)

(52) U.S. Cl. ..... 510/515; 510/447; 510/276; 510/327; 510/513

(58) Field of Classification Search ..... 510/515, 510/447, 108, 109, 276, 287, 294, 324, 327, 510/384, 389, 445, 451, 513; 8/137
See application file for complete search history.

(56) References Cited

U.S. PATENT DOCUMENTS

| | | | | |
|---|---|---|---|---|
| 3,759,846 | A * | 9/1973 | MacDonald et al. | 510/327 |
| 4,769,159 | A * | 9/1988 | Copeland | 8/137 |
| 4,828,745 | A | 5/1989 | Jeschke et al. | |
| 4,999,124 | A | 3/1991 | Copeland | |
| 5,372,593 | A | 12/1994 | Boehringer et al. | |
| 5,505,866 | A * | 4/1996 | Bacon et al. | 510/517 |
| 5,531,910 | A * | 7/1996 | Severns et al. | 510/102 |
| 5,668,094 | A | 9/1997 | Bacon et al. | |
| 5,792,219 | A * | 8/1998 | Hartman et al. | 8/137 |
| 6,494,920 | B1 | 12/2002 | Weuthen et al. | |
| 2003/0060390 | A1 | 3/2003 | Demeyere et al. | |
| 2003/0195130 | A1 | 10/2003 | Lentsch et al. | |
| 2004/0014632 | A1 * | 1/2004 | Howard et al. | 510/515 |
| 2004/0204337 | A1 | 10/2004 | Corona et al. | |
| 2004/0229769 | A1 | 11/2004 | Smith et al. | |
| 2007/0054835 | A1 * | 3/2007 | Corona et al. | 510/515 |

OTHER PUBLICATIONS

PCT International Search Report Dated Jan. 11, 2008—3 pgs.

* cited by examiner

*Primary Examiner* — Mark Eashoo
*Assistant Examiner* — Jane L Stanley
(74) *Attorney, Agent, or Firm* — James F. McBride; Melissa G. Krasovec; Leonard W. Lewis

(57) ABSTRACT

A mixture, apparatus, and method is provided for formulating, solidifying, packaging, shipping, and reprocessing laundry active for purposes of providing laundry active product to developing markets.

9 Claims, 4 Drawing Sheets

METHOD OF SHIPPING AND PREPARING LAUNDRY ACTIVES

BACKGROUND OF THE INVENTION

There is a continuing need to identify methods of shipping laundry actives and other raw materials to expanding markets that overcome the cost-prohibitive barriers associated with investing capital in more conventional on-site production facilities at the targeted market.

Methods of shipping laundry actives, such as fabric softening actives (e.g., quaternary ammonium compounds) and detersive surfactants, include using large, on the order of 20,000 kg, shipping containers wherein a molten form of the laundry active is poured into the container and allowed to cool and solidify before being shipped. Upon arrival, heat is applied to the container to melt the solid laundry active, and the molten laundry active is then extracted from the container. There are significant capital costs and expenses associated with purchasing, maintaining and handling these large, heavy shipping containers. Additionally, heating the laundry active in such large shipping containers to extract the laundry active is problematic because part of the laundry active may become unstable and degrade under the conditions required for entirely melting the solid laundry active in a reasonable time.

Another method of shipping laundry actives is to manufacture the active as chips or flakes. The chips or flakes are typically transported in bags that contain about 23 kg (50 lb) of the material. Shipping laundry actives in this manner requires additional capital investment in the equipment required to produce the actives in this form and in the equipment needed to fill the bags. Filling and emptying bags is labor intensive and time consuming, and the bags are typically made from non-recyclable or non-reusable materials. Moreover, the chips or flakes tend to stick together and form large chunks, which further complicates their use in downstream product formulation.

There is a need to provide a low cost way to ship laundry actives, particularly to developing markets, in a form that requires low capital investment and reduced labor costs.

SUMMARY OF THE INVENTION

The present invention attempts to satisfy these and other needs by providing, in a first aspect of the invention, a laundry active form that is produced by pouring molten laundry active into a casting mold and allowing the molten laundry active to solidify to a solid. The laundry active form is molded into a size that is capable of being shipped to developing markets.

Another aspect of the invention provides grinding a substantially solid laundry active form in a grinder into the form of a powder or granule.

Another aspect of the invention provides a process for hydrating the ground laundry active into a hydrated laundry active with water.

Another aspect of the invention provides a laundry active form that is a solid and has a mass from about 15 kg to about 35 kg, the laundry active form comprises a fabric softener active and from about 5 wt % to about 20 wt % by weight of the laundry active form of a diluent with the diluent comprising a hard tallow, from about 60 wt % to about 90 wt % by weight of the diluent; glycerin, from about 5 wt % to about 20 wt % by weight of the diluent; and glycerol monostearate, glycerol di-stearate, or combinations thereof, from about 5 wt % to about 20 wt % by weight of the diluent.

These and other features, aspects, and advantages of the present invention will become better understood from the following detailed description, claims, and accompanying drawings that illustrate, by way of example, the principles of the invention.

DETAILED DESCRIPTION OF THE INVENTION

At least one aspect of the invention is directed to supply chain enhancements that facilitate a laundry active to be delivered in a final product form to developing markets where capital has not been invested to manufacture laundry active products through conventional processes. Conventional processes typically use equipment and fixed infrastructure that cannot be easily transported (i.e., placed on a skid or capable of being easily moved in some other way).

The accompanying figures represent an embodiment of the invention.

Figure 1:
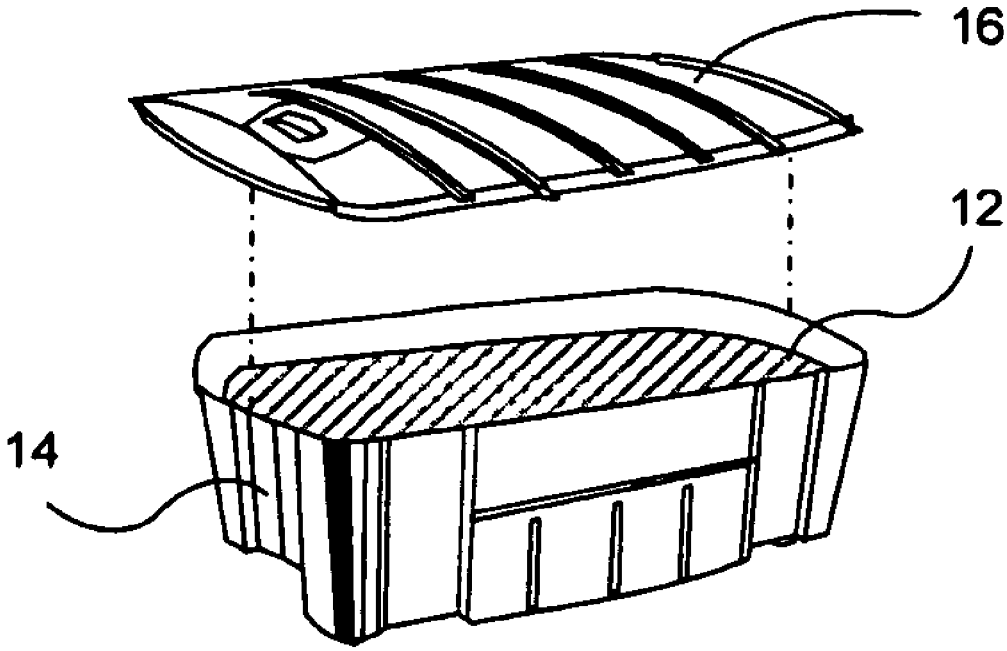
FIG. 1 is a laundry active form cast within a casting mold.

FIG. 1 illustrates the laundry active form 12 that results from casting a molten laundry active into a casting mold 14. An optional lid 16 may be provided with the casting mold. The molten laundry active is solidified into a laundry active form 12. This process places the laundry active in a form that can minimize handling and transportation costs.

Figure 2:
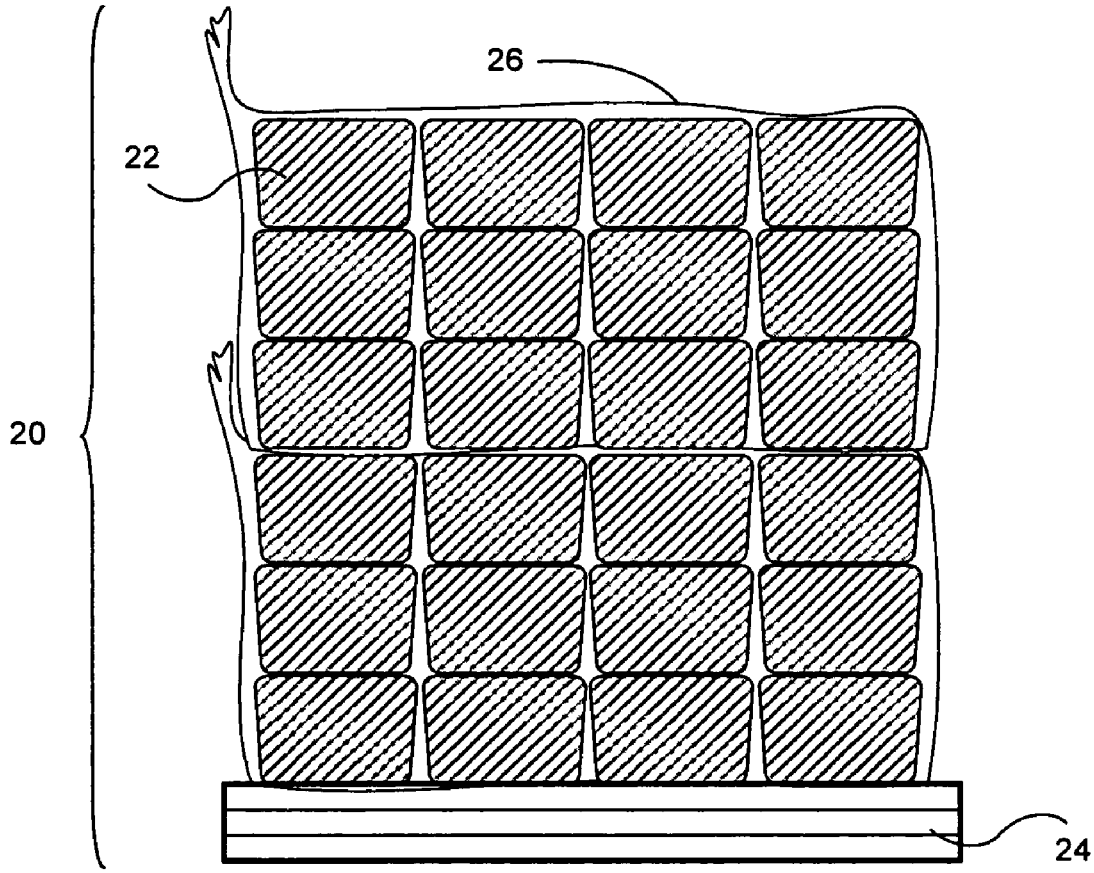
FIG. 2 is a plurality of laundry active forms, as represented in FIG. 1, stacked on a pallet to comprise a shipping assembly and secured by a securing mechanism.

FIG. 2 illustrates that the laundry active form 12 is capable of being stacked on a pallet 24 and on one another to comprise a shipping assembly 20 for shipping a plurality of laundry active forms 22 stacked on a pallet 24. The shipping assembly 20 is more convenient and less expensive to transport to remote regions where product supply is needed. The laundry active form 12 may be stacked while remaining in the casting mold 14 optionally enclosed with a lid 16. In another embodiment, a laundry active form 12 may be stacked after having been solidified and removed from the casting mold 14. The plurality of laundry active forms 22 that are stacked on the pallet 24 may be wrapped with a plastic stretch wrap 26 or some other securing mechanism.

Figure 3:
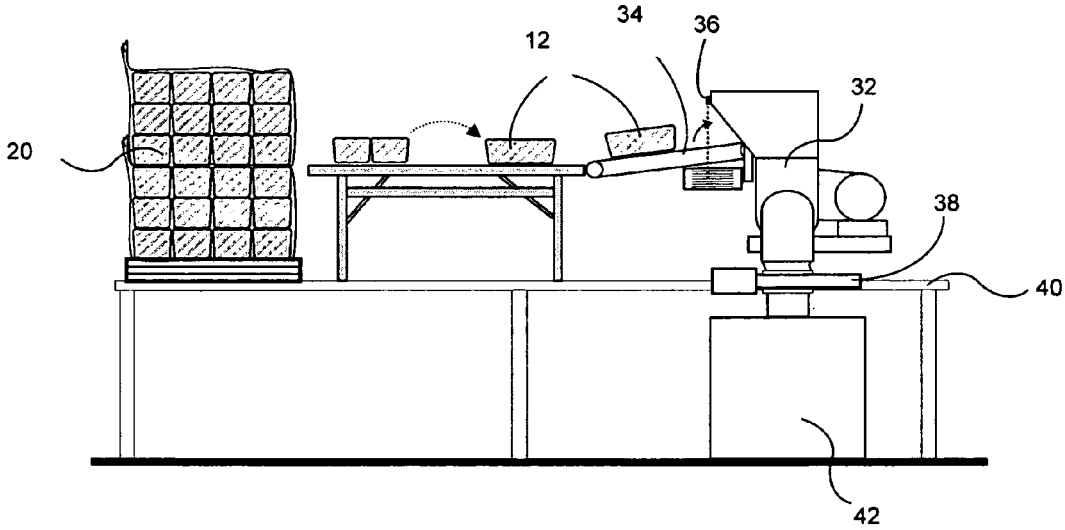
FIG. 3 is a method of processing a laundry active form removed from a shipping assembly, the shipping assembly represented by the embodiment of FIG. 2, where the laundry active form is ground by a grinder into a ground laundry active and the ground laundry active is further subjected to a hydration process.

Once the shipping assembly 20 has arrived at the target destination, the laundry active form 12 can be processed into a ground laundry active through several steps as illustrated in FIG. 3. The laundry active form 12 has a mass (e.g., about 10 kg to about 35 kg) such that it is capable of being manually removed from the shipping assembly 20 by a removing step; placed on a conveyor 34 (e.g., a belt conveyor) by a placing step; and conveyed to a grinder 32 by a conveying step. The number of laundry active forms 12 processed by the grinder may be counted (e.g., by a photoelectric eye-type sensor) by a counting step 36. A slide gate 38 may be used to control the flow of ground laundry active exiting the grinder 32. The grinder is typically situated on a platform 40 such that the ground laundry active exiting the grinder may be gravity fed to a hydration step 42. Optionally, the ground laundry active exiting the grinder may be screened to control the size of the ground laundry active.

Figure 4:
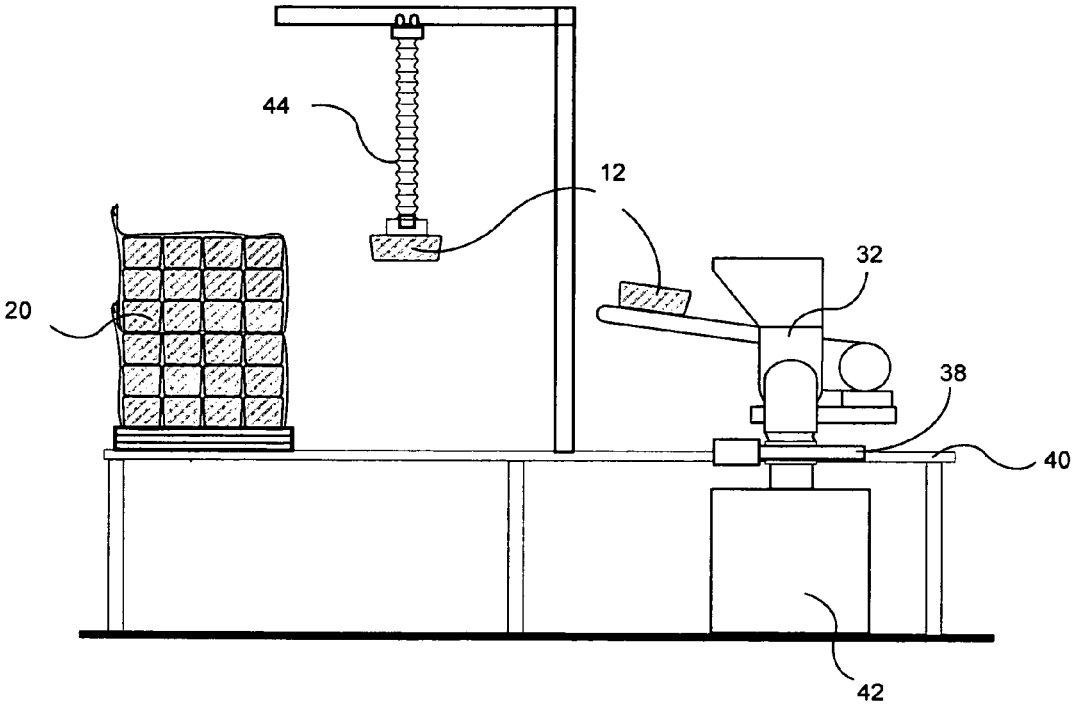
FIG. 4 is a method of processing a laundry active form showing a unitized method of removing, placing, and conveying a laundry active form from a shipping assembly, the shipping assembly represented by the embodiment of FIG. 2, where the laundry active form is ground by a grinder into a ground laundry active and the ground laundry active is further subjected to a hydration process.

FIG. 4 illustrates a unitized mechanism 44, such as a vacuum lift, for removing, placing, and conveying the laundry active form 12 from the shipping assembly 20 to a grinder 32 situated on a platform 40.

1. Laundry Active Form

"Laundry active form" means a laundry active that is a solid such that the form may be handled manually such as when being removed from a pallet, independent of the casting mold or any other containment mechanism, without the laundry active form substantially losing its shape. In one embodiment, the laundry active form is solid enough such that multiple forms can be stacked on each other independent of a casting mold free of a protective, non-structable layer. Explicitly not included as part of a laundry active form are flakes and/or granules that comprise detergent actives.

Non-limiting but illustrative examples of methods for producing the laundry active form include casting a laundry active in a casting mold, extruding a laundry active into the laundry active form, or compressing a powder or granular laundry active into the laundry active form.

In one embodiment, when a laundry active form is produced by casting a laundry active in a casting mold, the laundry active form is capable of being removed from the casting mold. In one embodiment, the laundry active form is removed from the casting mold by vacuum assisted lifting. Examples of equipment capable of vacuum assisted lifting include the vacuum lifters manufactured by Palamatic Handling USA, Inc., P.O. Box 2020, West Chester, Pa. 19380 USA. In another embodiment, the laundry active form is manually removed from the casting mold by turning the casting mold over or removed by any other device, mechanism, or approach capable of removing the laundry active form from the casting mold.

The laundry active form has a mass of at least about 0.2 kg, alternatively at least about 0.5 kg, 1 kg, 2 kg, 4 kg, 5 kg, 8 kg, 10 kg, 12 kg, 15 kg, 20 kg, or about 25 kg; alternatively less that about 2,000 kg, 1,500 kg, 1,000 kg, 750 kg, 500 kg, 250 kg, 125 kg, 100 kg, 80 kg, 75 kg, 50 kg, 35 kg, or about 25 kg. A number of factors can be determinative of the mass and/or size of the laundry active form including, but not limited to, manual portability of the laundry active form, ability to solidify the laundry active cast in a casting mold in a reasonable time, cost of transporting the laundry active form or a plurality of laundry active forms, and/or capability of grinding the laundry active form in a grinder at the targeted destination into a ground laundry active that is capable of being hydrated or undergoing further processing. One skilled in the art would be able to account for such factors.

Because a laundry active form is typically being shipped to and processed at a developing region that may not have a well-developed infrastructure, it may be more economically beneficial to use manual labor to remove, place, and/or convey a laundry active form from the shipping assembly to the grinder. Under these conditions, it is necessary to limit the mass of the laundry active form to a weight that is practical and/or safe for a person to manually lift.

While not intending to be bound by theory, the mass of the laundry active form is related to the volume of the laundry active form. A laundry active form having a larger volume usually takes longer to solidify than a laundry active form having a smaller volume, particularly towards the center of the laundry active form. The laundry active may have properties that are insulative in nature (e.g., for laundry actives that comprise quaternary ammonium compounds) further increasing the time it takes to solidify the laundry active form. The size of the casting mold, which is capable of impacting the mass of the laundry active form, can be chosen such that the laundry active can be solidified to a laundry active form over a reasonable period of time when exposed to a temperature from about −17° C. to about 50° C.—e.g., less than about 48 hr, alternatively from about 12 hr to about 36 hr, alternatively from about 18 hr to 30 hr, alternatively from about 18 hr to about 22 hr. It is well-known by those skilled in the art that cooling times can be influenced by the use of refrigeration, forced convection, or other mechanisms that allows for quicker heat dissipation from the laundry active, laundry active form, and/or casting mold.

The size and shape of the laundry active form may impact how efficiently a laundry active form or a plurality of laundry active forms are packaged in a shipping assembly for transporting to a target location. This influences the transportation costs associated with shipping a needed amount of laundry active to the target location.

The grinder for grinding the laundry active form into a ground laundry active is typically limited to processing a laundry active form over a predetermined range of sizes described herein. Optionally, the grinding system may be skid mounted to make the system more portable.

In one embodiment, the laundry active form has a total surface area between about 200 $cm^2$ to about 80,000 $cm^2$, alternatively between about 750 $cm^2$ to about 10,000 $cm^2$, alternatively between about 2,000 $cm^2$ to about 6,000 $cm^2$.

"Laundry active" is used herein in the broadest sense to comprise any intermediate, near-final, and/or final form of any compound that can be used to impart a desirable benefit to fabric during the laundering processes (i.e., washing, rinsing, or drying processes) including, but not limited to, detergent surfactants, detergent builders, bleaching agents, fabric softening actives, or combinations thereof. Non-limiting examples of a desirable benefit to fabric includes a cleansing benefit, a fabric softening benefit, or a combination thereof.

In one embodiment, the laundry active is a detergent surfactant. The term "detergent surfactant" means a surfactant wherein the surfactant is a detersive surfactant, which is characterized by its detersive action in removing soil and/or stains from fabrics. Non-limiting examples of surfactants include a cationic surfactant, anionic surfactant, zwitterionic surfactant, nonionic surfactant, or combinations thereof.

In another embodiment, the laundry active is a fabric softening active. The term "fabric softening active" means a compound that may be deposited on fabric during the laundering processes, e.g., through a rinse solution, alternatively a first rinse solution (e.g., "Single Rinse Fabric Softener"), or in a laundry dryer to provide a softening effect to the laundered fabrics and includes, but is not limited to, a cationic softening compound. Non-limiting examples of fabric softening actives include quaternary ammonium compounds such as alkylated quaternary ammonium compounds, ring or cyclic quaternary ammonium compounds, aromatic quaternary ammonium compounds, diquaternary ammonium compounds, alkoxylated quaternary ammonium compounds, amidoamine quaternary ammonium compounds, ester quaternary ammonium compounds, and mixtures thereof. See e.g., U.S. Pat. Pub. No. 2004/0204337 A1, published Oct. 14, 2004 to Corona et al., from paragraphs 30-79; U.S. Pat. Pub.

No. 2004/0229769 A1, published Nov. 18, 2005, to Smith et al., from paragraphs 26-31; or U.S. Pat. No. 6,494,920, at col. 1, line 51 et seq.

Other non-limiting examples of laundry actives include methyl-diethanolamine (MDEA)-derived active; tri-ethanolamine (TEA)-derived dialkyl-esterquats, including monoester-, diester-, triester-quat, or combinations thereof; epichlorohydrin-derived active; N-(2-hydroxyethyl)-N-(2-aminoethyl)ethylenediamine-based active; diethylenetriamine-derived active; aminoethylethanolamine-derived active; tallowyl fatty alcohol-derived active; 2-ethylhexanal and tallowyl fatty alcohol-derived active; N-methylethanolamine-derived active; dialkylamidoamine-derived actives; ditallow dimethyl ammonium chloride (DHTDMAC)-based active; octadecanaminium,N,N-dimethyl-N-octadecyl-chloride (DSDMAC)-based active; dimethyl ditallow ammonium chloride, dimethylditallow alkyl chlorides, ditallow dimethyl ammonium chloride, or dimethylditallow alkylammonium chlorides (DTDMAC)-based actives; ethyl methyl sulfonate; or combinations thereof.

In one embodiment, the fabric softener active comprises a monoester quaternary ammonium compound from about 1 wt % to about 50 wt % by weight of the fabric softener active, alternatively from about 10 wt % to about 40 wt % by weight of the fabric softener active, alternatively from about 15 wt % to about 30 wt % by weight of the fabric softener active, alternatively from about 18 wt % to about 20 wt % by weight of the fabric softener active. In one embodiment, the fabric softener active comprises from about 1 wt % to about 50 wt % by weight of the fabric softener active of a monoalkyl ammonium compound. Non-limiting examples of monoalkyl ammonium compounds includes monolauryl trimethyl ammonium chloride, hydroxycetyl hydroxyethyl dimethyl ammonium chloride, behenyl trimethyl ammonium chloride, ethyl bis(polyethoxy ethanol)alkylammonium ethylsulfate, polyethylene glycols, polymeric quaternary ammonium salts, vinylpyrrolidone/methacrylamidopropyltrimethylammonium chloride copolymer, quaternized polyethyleneimines, monotallow trimethyl ammonium chloride, or triethonium hydrolyzed collagen ethosulfate. In one embodiment, the fabric softener active is essentially free of monoester or monoalkyl ammonium compounds.

While the present invention is shown and described in considerable detail with respect to an active that comprises a laundry active, it should be understood by those skilled in the art that the invention is not limited to actives that only comprise a laundry active. Rather, illustrative non-limiting examples of additional types of actives may include other soap actives, surface cleaning actives, food actives, flavoring actives, and perfume actives.

The laundry active form may optionally comprise a diluent. "Diluent" means an additive used in the preparation of the laundry active prior to a molten form of the laundry active being dispensed into a casting mold. While not intending to be bound by theory, a diluent typically is used to control the viscosity of the reaction mixture for producing the laundry active. In one embodiment, the diluent does not substantially affect the yield of laundry active. In one embodiment, the diluent is not substantially detrimental to the performance and/or stability of the laundry active. In one embodiment, the diluent enhances the performance and/or stability of the laundry active.

In one embodiment, the choice of type and amount of diluent relative to the laundry active is such that a desired melt range characteristic is achieved allowing the laundry active form to remain as a solid under the expected range of temperatures the laundry active form may be exposed to during packaging, transporting, and grinding. In one embodiment, the minimum melting temperature of the laundry active form is about 40° C. as determined, for example, by differential scanning calorimetry. In another embodiment, the diluent is chosen such that the laundry active form has a peak melt temperature above about 40° C., alternatively from about 40° C. to about 45° C., alternatively about 40.5° C. to about 42° C. as determined, for example, by differential scanning calorimetry. In another embodiment, the diluent is chosen such that about 80 wt % of the laundry active form melts above about 40° C. as determined, for example, by differential scanning calorimetry. One example of differential scanning calorimetry is with the use of a Perkin-Elmer DSC-7 Differential Scanning Calorimeter with the following parameters: $t_{init}$ at 0° C., $y_{init}$ at 20 wM, purge gas is nitrogen, purge gas rate is 20 ml/min, sample rate is at the standard setting, and pan type is aluminum. The procedure includes: 1) holding for 3 min at 0° C.; 2) heating from 0° C. to 90° C. at 5° C./min; 3) holding for 3 min at 90° C.; and 4) cooling from 90° C. to 0° C. at 5° C./min.

In one embodiment, the diluent is chosen such that the laundry active form is easily removed from the casting mold. In one embodiment, a diluent is chosen such that a laundry active form is capable of being ground into a non-flammable ground laundry active. Non-limiting examples of diluents include hard tallow such as hydrogenated edible tallow or, more specifically, hydrogenated tallow (H-tallow) acid; hydrogenated alkyl esters; glycerol monostearate; glycerin, alcohols; alcohol ethoxylates; polyalkylene glycols; fatty acids; fatty methyl esters; triglycerides; or combinations thereof. In one embodiment, the diluent is essentially free of water.

In one embodiment, the laundry active comprises a fabric softener active and a diluent wherein the diluent comprises hard tallow such as hydrogenated edible tallow or, more specifically, hydrogenated tallow (H-tallow) acid. In another embodiment, the diluent further comprises glycerol monostearate, glycerol di-stearate, or combinations thereof (e.g., Stepan GMS Pure produced by Stepan); and in another embodiment, the diluent further comprises glycerin (e.g., Glycerin Star produced by Procter & Gamble Chemicals).

In one embodiment, a laundry active form comprises a diluent from at least about 2 wt %, alternatively at least about 3 wt %, 5 wt %, 7 wt %, 8 wt %, 10 wt %, 15 wt %, 20 wt %, 25 wt %, 30 wt %, 35 wt %, or 40 wt %; but less than about 40 wt %, alternatively less than about 35 wt %, 30 wt %, 25 wt %, 20 wt %, 15 wt %, or 12 wt % by weight of the laundry active form.

In one embodiment, the laundry active form comprises a diluent comprising at least one of glycerol; a monoester glycerol; a diester glycerol; and/or a triester glycerol with the monoester glycerol, the diester glycerol, and/or the triester glycerol comprising a fatty acid group with the fatty acid group comprising a C10 to C20 alkyl fatty acid, a C10 to C20 alkenyl fatty acid, or combinations thereof.

In one embodiment, the laundry active form comprises a diluent comprising at least one of: a hard tallow; glycerin; and/or glycerol monostearate, glycerol di-stearate, or combination thereof. In one embodiment, the laundry active form comprises a fabric softener active and a diluent wherein the diluent comprises from about 60 wt % to about 95 wt % of a hard tallow by weight of the diluent and about 5 wt % to about 40 wt % of glycerin by weight of the diluent, alternatively from about 75 wt % to about 90 wt % of a hard tallow by weight of the diluent and about 10 wt % to about 25 wt % of glycerin by weight of the diluent, alternatively from about 80 wt % to about 90 wt % of a hard tallow by weight of the diluent and about 10 wt % to about 20 wt % of glycerin by weight of the diluent. In another embodiment, the diluent additionally comprises about 5 wt % to about 40 wt %, alternatively about 10 wt % to about 25 wt %, alternatively about 10 wt % to about 20 wt % of glycerol monostearate, glycerol di-stearate, or combinations thereof by weight of the diluent. In another embodiment, the amount of glycerin and/or glycerol monostearate, glycerol di-stearate, or combination thereof used in proportion to hard tallow is such that the diluent and laundry active remains miscible over optimal reaction conditions for production of the laundry active and produces a homogeneous laundry active form. In another embodiment, the laundry active comprises a fabric softener active and a diluent wherein the diluent comprises a hard tallow from about 78 wt % to about 82 wt % by weight of the diluent; glycerin from about 8 wt % to about 12 wt % by weight of the diluent; and glycerol monostearate, glycerol di-stearate, or combinations thereof from about 8 wt % to about 12 wt % by weight of the diluent.

An embodiment of the invention involves a laundry active form that comprises a fabric softener active and a diluent that is essentially free of a low boiling point flammable material, such as isopropanol or ethanol, to avoid producing a laundry active and diluent, laundry active form, and/or ground laundry active that is potentially flammable under ambient conditions. In one embodiment, the laundry active form comprises a fabric softener active and a diluent that is essentially free of alcohol.

In another embodiment, the diluent that has a flashpoint greater than about 100° C., alternatively greater than about 125° C., alternatively less than about 300° C. Suitable ways of determining flashpoint include either a Tag Closed Tester (ASTM D-56-70) or Pensky-Martens Closed Tester (ASTM D-93-71). In another embodiment, the flashpoint of the laundry active and diluent is greater than about 125° C., alternatively greater than about 135° C., alternatively less than about 325° C. In yet another embodiment, the ground laundry active has a flashpoint greater than about 125° C., alternatively greater than about 135° C., alternatively less than about 325° C.

In one embodiment, the diluent is such that the laundry active form is capable of being ground into a ground laundry active that is in the form of a flake, prill, powder, pumpable solid, fluidizable solid, and/or suspended solid in a fluid medium.

Optionally, the laundry active form comprises a fabric softener active and a surfactant scavenger that scavenges the final mixture for carryover surfactant to allow the finished laundry active to provide softness and to reduce static. Non-limiting examples of a surfactant scavenger includes monoalkylquats such as N-tallowyloxyethy-N,N,N-trimethylammonium chloride, monotallow trimethyl ammonium chloride, hydrolyzed cationic polysaccharide (HCP), and starches that contain high levels of amylose such as HYLON. In one embodiment, the laundry active form comprises a fabric softener active and from about 0.01 wt % to about 5 wt % of a surfactant scavenger, alternatively from about 0.01 wt % to about 1 wt % of a surfactant scavenger, alternatively from about 0.02 wt % to about 0.4 wt % of a surfactant scavenger, alternatively from about 0.05 wt % to about 0.2 wt % of a surfactant scavenger. Suitable surfactant scavengers (referred to as "suds suppressing system") are disclosed in US 2003/0060390 A1, at paragraphs 65-77.

Optionally, the laundry active form comprises a fabric softener active and a dispersant that assists in vesicle formation upon hydration and/or reconstitution. Non-limiting examples of dispersants include tallow alcohol ethoxylates, specifically TAE80; Tween 20 (PBS-TWEEN commercially available from Atlas Chemical Co.); and NEODOL 23-9, an ethoxylated primary alcohol having about 9 moles of ethylene oxide. In one embodiment, the laundry active form comprises a fabric softener active and from about 0.01 wt % to about 1 wt % of a dispersant, alternatively from about 0.2 wt % to about 1 wt % of a dispersant, alternatively from about 0.2 wt % to about 0.6 wt % of a dispersant.

In one embodiment, the laundry active form comprises a builder from less than about 10 wt %, alternatively less than about 5 wt %, 1 wt %, or 0.1 wt % by weight of the laundry active form. The builder may be an organic builder, inorganic builder, or combination thereof. Organic builders include organic chelate builder, polymer electrolytic builder, and/or organic activating builder. The organic builders may be water soluble or water insoluble. In one embodiment, the laundry active form is essentially free of a builder.

In one embodiment, the laundry active form is free or essentially free of perfume, dye, suds suppressor, or combinations thereof.

In one embodiment, the laundry active form comprises a laundry active that comprises a fabric softener active, wherein the laundry active form is free of an attachment mechanism for attaching the laundry active form to a surface such as the attachment mechanism described in US 2003/0195130 A1 at paragraph 27.

In one embodiment, the laundry active form is free of a product carrier such as that described in US 2003/0195130 A1 at paragraphs 18-23.

In one embodiment, the laundry active form is free of fusing to one another such as that disclosed in U.S. Pat. No. 4,828,745 at col. 2, lines 57-58.

Additional examples of compositions of laundry active can be found in U.S. Ser. No. 60/713,016 entitled "Concentrated Fabric Softener Active Compositions" filed Aug. 31, 2005 (P&G Case 10123P) and the utility application there.

2. Casting Mold

The casting mold is typically determinative of the mass, size, and/or shape of the laundry active form. "Casting mold" means any container capable of containing a molten laundry active. In one embodiment, the molten laundry active contained in the casting mold cools to form a laundry active form. In one embodiment, the casting mold is capable of holding a volume of the molten laundry active from about 0.2 liter to about 2,000 liters, alternatively about 2 liters to about 92 liters, alternatively about 12 liters to about 36 liters, of the molten laundry active. The shape of the casting mold can be cubic, rectangular, spherical, cylindrical, or any other shape suitable for casting a laundry active form. Non-limiting examples of casting molds include reusable containers available from ORBIS Corporation, a subsidiary of Menasha Corporation, 1645 Bergstrom Road, Neenah, Wis. 54956 USA or the PLEXTON STACK-N-NEST containers available from LEWISBins+, a division of ORBIS Corporation, 1055 Corporate Center Drive, P.O. Box 389, Oconomowoc, Wis. 53066 USA.

Optionally, the casting mold may be equipped with a lid and/or be designed in such a way to allow the casting mold to be capable of being stacked. This will optionally allow the laundry active to be transported while still in its casting mold even before becoming fully solidified to a laundry active form that is a solid.

In one embodiment, the casting mold and optional lid is reusable.

In one embodiment, an empty casting mold is capable of being nested in another empty casting mold to allow the casting molds to be efficiently stacked when not in use.

The casting mold has geometry, size and material of construction that enables the laundry active to be solidified in a reasonable period of time and produces a laundry active form that can be easily withdrawn from the casting mold and then packaged and transported. In one embodiment, the casting mold is shaped as a hollow trapezoidal solid resembling the frustum of a rectangular pyramid wherein the inside length of the top of the casting mold can be greater than the inside length of the base of the casting mold and wherein the inside width of the top of the casting mold can be greater than the inside width of the base of the casting mold. In one embodiment, a casting mold shaped as a hollow trapezoidal solid has inside dimensions at the base from about 36 cm to about 54 cm in length and about 23 cm to about 45 cm in width, inside dimensions at the top from about 40 cm to about 59 cm in length and about 25 cm to about 48 cm in width, and inside dimension from about 12 cm to about 36 cm in height. In another embodiment, a casting mold shaped as a hollow trapezoidal solid has a base with inside area from about 800 $cm^2$ to about 2,500 $cm^2$, a top with inside area from about 1,000 $cm^2$ to about 3,000 $cm^2$, and an inside volume from about 10 liters to about 100 liters, alternatively from about 15 liters to about 45 liters, alternatively from about 18 liters to about 40 liters.

The shape the casting mold imparts to the laundry active form may be chosen for efficiency in packaging (e.g., cubic or rectangular), convenience in portability such as by rolling (e.g., spherical or cylindrical), or overall efficiency between stacking a laundry active form and storage of an unused casting mold (e.g., hollow trapezoidal solid). In one embodiment, the laundry active form that is solidified in the casting mold is of a shape and size that allows for efficient packaging, portability, and provides for ease of conveyance. The material of construction of the casting mold typically is selected for durability and for properties that facilitate cooling of the molten laundry active such that the active contained therein remains stable and the laundry active form becomes solidified to a solid within a desired time.

Non-limiting examples of materials used in the construction of the casting mold include fiberglass, plastic, metal, glass, or combinations thereof. In one embodiment, the casting mold is constructed of a material that maintains its shape at temperatures in excess greater than about 110° C., alternatively in excess greater than about 90° C., alternatively in excess greater than about 50° C. In one embodiment, the casting mold is leak tight.

3. Shipping Assembly

The shipping assembly for a laundry active form or a plurality of laundry active forms is packaged by stacking a laundry active form or a plurality of laundry active forms on a pallet optionally enclosing the shipping assembly in a securing mechanism. "Shipping assembly" refers to the combination of a laundry active form and a pallet.

The pallet may be comprised of wood, paper, metal, plastic, or combinations thereof. In one embodiment, the pallet is capable of being moved by a forklift and transported, e.g., by a cargo ship. A pallet that is not comprised of wood (versus one constructed e.g. of paper) is preferred. Pallets comprised of wood are sometimes subject to regulations and inspections and, as such, are sometimes subject to transactional expenses or transportation delays. Non-limiting examples of pallets may include press pallets, double-sided pallets, stratis paks, roll pallets, racking pallets, nestable pallets, or export pallets. A manufacturer of a plastic pallet includes Stratis Corporation, 5677 W. 73rd Street, Indianapolis, Ind. 46278 USA. A non-limiting dimension of a pallet is 122 cm×102 cm×15 cm.

In one embodiment, the pallet is a type that is inexpensive relative to other pallets and is capable of shipping laundry active forms being exported. In one embodiment, the pallet is a corrugated pallet. An example of a corrugated pallet includes the SURE STACKER manufactured by Packaging Unlimited, 2251 Augustine Ave., Covington, Ky. 41014 USA.

While the dimensions may vary substantially, a non-limiting dimension of the shipping assembly may be a height from about 100 cm to about 122 cm giving the shipping assembly a volume from about 1,200 liters to about 1,700 liters. A full loaded pallet may comprise, in one embodiment, a mass from about 100 kg to about 2,000 kg, alternatively from about 250 kg to about 1,000 kg.

In one embodiment, the packing density for the shipping assembly is from about 60% to about 100%, alternatively from about 70% to about 100%, alternatively from about 70% to about 90%, alternatively from about 75% to about 85%. Packing density is defined as the ratio of the density of one or more laundry active forms stacked on a pallet to the density of a laundry active form expressed as a percentage.

In one embodiment, the shipping assembly comprises one or more casting molds that are stacked with the laundry active or laundry active form contained therein. In another embodiment, the shipping assembly is free or substantially free of a casting mold. In yet another embodiment, the shipping assembly further comprises a securing mechanism.

"Securing mechanism" is used herein in the broadest sense to include any means of securing one or more laundry active forms to one another and/or to the pallet such that one or more of the laundry active forms do not become displaced from the shipping assembly during transport of the shipping assembly. The securing mechanism may also be capable of protecting one or more of the laundry active forms from rain, water, or other environmental conditions or other contaminants in which the shipping assembly may be exposed. Non-limiting examples of a securing mechanism include a shrink wrap, a stretch wrap, an encasement for the shipping assembly constructed of fiberglass, plastic, cardboard, wood, or combinations thereof. In one embodiment, the stretch wrap is a plastic that can be wrapped after one or more layers of laundry active form(s) have been stacked or, in another embodiment, wrapped over each of the layers of the shipping assembly. In one embodiment, the plastic has a width from about 25 cm to about 92 cm and has a thickness from about 0.6 mil to about 10 mil, alternatively from about 1 mil to about 6 mil, alternatively from about 2.5 mil to about 3.5 mil. Examples of potentially suitable plastics are those supplied by Uline, 2105 S. Lakeside Dr., Waukegan, Ill. 60085 USA.

The shipping assembly can be shipped by any known means including rail or ship and can be moved by using a forklift or any other device, mechanism, or approach capable of moving the shipping assembly.

4. Ground Laundry Active

"Ground laundry active" means the form of the laundry active after the laundry active form is subjected to grinding. The grinding process eliminates the need for a re-melt unit operation serving to reduce reprocessing costs and preventing a potential loss in product stability that can result from the re-melt operation. In one embodiment, the ground laundry active are particles wherein the maximum particle size does not exceed about 13 mm. In one embodiment, the ground laundry active is in the form of a powder or granule wherein the average particle size is from about 0.01 mm to about 100 mm, alternatively from about 0.01 mm to about 30 mm, alternatively from about 0.01 mm to about 10 mm, alternatively from about 1 mm to about 10 mm, alternatively from about 2 mm to about 7 mm. Particle size refers to the diameter of the smallest sphere that will completely enclose the particle and can be measured using, e.g., a HORIBA Model LA 900 laser diffraction particle size instrument that is manufactured by HORIBA Jobin Yvon Inc., 3880 Park Ave., Edison, N.J. 08820 USA or a MULTIZER 3 manufactured by Beckman Coulter, Inc., 250 South Kraemer Blvd., Brea, Calif. 92822 USA. Alternatively, the particle size can be estimated with the use of a caliper or an appropriately marked ruler.

In one embodiment, the range of the particle sizes for the ground laundry active are such that faster particle melt and dissolution is achieved during hydration resulting in a faster hydration time.

In one embodiment, the ground laundry active is in the form of a flake. "Flake" means ground laundry active that is in the form of a thin, flattened piece or layer such as a chip. A flake typically has a thickness of less than about 10 mm. In one embodiment, the flake has a surface area to unit mass of less than about 1 $cm^2/g$ but less than about 2 $cm^2/g$ to better facilitate hydration of the ground laundry active.

The process of grinding a laundry active form in a grinder produces a ground laundry active. The term "grind" or "grinding" means the process by which the laundry active form is reduced to a desirable particle size having a volume and/or surface area that enables the laundry active to be more readily hydrated including melting and/or dissolving within the water used for hydration. In one embodiment, the pallet comprising one or more laundry active forms is positioned next to a conveyor, such as a conveyor belt, whereby a laundry active form is removed from the pallet by a removing step, placed on the conveyor by a placing step, and conveyed to the grinder by a conveying step. In another embodiment, a lift is used to lift the pallet to facilitate removing and placing the laundry active form from the pallet onto the conveyor. Ergonomic benefits may also be achieved in using a lift, particularly if the laundry active form is manually removed from the pallet. An example of a lift includes the Southworth Backsaver that is available in a variety of sizes and lift capabilities available from Southworth Products, 11 Gray Rd., Falmouth, Me. 04105 USA.

The grinder is positioned such that the conveyor conveys the laundry active form into the grinder. In one embodiment, the grinder is situated such that the ground laundry active produced from the grinder is sent to a container suitable for hydrating the ground laundry active. An example of a grinder includes the Bepex Rietz EXTRUCTOR, e.g., model number RE-15, manufactured by Bepex International LLC, 333 N.E. Taft St., Minneapolis, Minn. 44513 USA.

The removing step and the placing step may be accomplished by manually removing the laundry active form from the shipping assembly and then manually placing the laundry active form on a conveyor. Alternatively, a harness and pulley system or some other mechanical assembly may accomplish the removing step. The placing step involves placing the laundry active form from the removing step on the conveyor such as manually or by a cam or movable tract system. The conveying step may be performed by a conveyor belt that is driven manually or by some other motorized mechanism. Alternatively, the conveying step may be performed by any other transport mechanism. The removing step, placing step, and conveying step may be performed by a unitized mechanism that accomplishes a combination of any two or even all three of the steps with the same device, mechanism, or approach. One having ordinary skill in the art will recognize such devices, mechanisms, or approaches for performing said steps for the grinding process. In one embodiment, the removing step, placing step, and conveying step may be accomplished sequentially in a manual operation. In another embodiment, the removing step, placing step, and conveying step are performed using a vacuum lifting system such as those manufactured by Palamatic Handling USA.

While not intending to be bound by theory, design features of the grinder such as the number of blades and/or the size of the blades can affect the size of the ground laundry active. While not intending to be bound by theory, the size of the ground laundry active can be affected by the speed at which the grinder operates. In one embodiment, the grinder operates between about 5 revolutions-per-minute to about 20 revolutions-per-minute.

Optionally, the size of the ground laundry active can be controlled by screening the ground laundry active exiting the grinder with the use of a screen. In one embodiment, the screen for screening the ground laundry active is sized such that the average particle size of the ground laundry active is about 2 mm to about 7 mm or, alternatively, the maximum size of the ground laundry active after screening does not exceed about 7 mm to about 30 mm. Typically, the size of the ground laundry active is such that it can be hydrated and is flowable at the operating conditions of the additional steps involved in further processing.

Optionally, the ground laundry active may be extruded as the ground laundry active exits the grinder wherein the grinder comprises an outer orifice plate or die through which the grinder pushes the ground laundry active through one or more orifices in the orifice plate or die. Alternatively, the grinder may comprise an internal orifice plate or die. While not intending to be bound by theory, the hole or holes in the orifice plate or die determine the shape and size of the ground laundry active. In one embodiment, a orifice hole has a diameter from about 2 mm to about 7 mm.

In one embodiment, the grinder used in the grinding step may be an EXTRUCTOR manufactured by Bepex International LLC, 333 N.E. Taft St., Minneapolis, Minn. 44513 USA.

In another embodiment, the process of grinding a laundry active form may involve the use of a delumping device which breaks the laundry active form into a ground laundry active by means of rotating hammers or teeth that continues to slice the material into pieces while being pushed through slits. In one embodiment, the slits have a rectangular shape.

In yet another embodiment, the process of grinding laundry active form comprises a delumping device and a grinder.

In one embodiment, the process of grinding a laundry active form may involve the additional step of controlling the flow of the ground laundry active exiting the grinder by a control assembly. A non-limiting example of a control assembly is a bellow connected to the outlet of the grinder wherein the rate at which the ground laundry active exits the grinder is controlled by a slide valve connected to the bellow.

The ground laundry active exiting the grinder may be stored for later use or may be hydrated or processed in some other manner.

5. Hydration

"Solvation" means the process by which ground laundry active is contacted with a solvent for a period of time known as the residence time. Typically the solvent comprises water. The solvent may also comprise a polar solvent, a non-polar solvent, or combinations thereof. The composition of the solvent depends on the laundry active and the application in which the finished laundry active is used.

In particular, when the ground laundry active is a fabric softener active, the ground laundry active typically undergoes hydration. "Hydration" means the process by which ground laundry active is contacted with water in a hydrator for a period of time known as the residence time. The ground laundry active and water can optionally be mixed when preparing the hydrated laundry active. In one embodiment, either the laundry active form or the ground laundry active is hydrated in a hydrator.

In one embodiment, hydration is carried out in a batchwise manner. In another embodiment, hydration is continuous with recirculation wherein part of the effluent stream from the hydrator is recirculated back to the hydrator. In another embodiment, hydration is continuous without recirculation.

In one embodiment, ground laundry active is added to a carrier fluid before hydration. Non-limiting examples of a carrier fluid include water, a polar solvent, a non-polar solvent, or combinations thereof.

In the embodiment where hydration is a batch hydration, the hydrator is a tank.

In one embodiment, the hydrator comprises a mixing mechanism. In one embodiment, the mixing mechanism is an agitator. In one embodiment, when a mixing mechanism is utilized, mixing is sufficient to achieve a uniform temperature of the ground laundry active and water mixture. In one embodiment, mixing is sufficient to achieve a uniform dissolved ground laundry active distribution within the water. In one embodiment, mixing does not cause foaming within the hydrator.

The ground laundry active may optionally be premixed with water prior to hydration, or alternatively, the ground laundry active may be added to water that already exists in the hydrator. In another embodiment, the ground laundry active may be both premixed with water and then the premixed mixture may be added to water that exists in the hydrator.

In one embodiment, the temperature of water used in hydration is about 90° C., alternatively about 70° C. to about 100° C., alternatively about 80° C. to about 95° C. In another embodiment, the combined temperature of water used in hydration and the ground laundry active is about 65° C. to about 70° C., alternatively about 65° C. to about 75° C., alternatively about 60° C. to about 80° C., alternatively about 50° C. to about 90° C.

In one embodiment, the hydration residence time is about 5 min, alternatively less than about 200 min, alternatively from about 1 min to about 30 min, alternatively from about 5 min to about 30 min, alternatively from about 5 min to about 10 min, wherein the hydration residence time is measured from about the time when the last amount of ground laundry active is added to water used in hydration to about the time when the hydrated ground laundry active is discharged from the hydrator.

While not intending to be bound by theory, the residence time may vary with the temperature of the water—water having a higher temperature may require a shorter residence time while water having a lower temperature may require a longer residence time, the surface area to mass ratio of the ground laundry active, and/or agitation. In one embodiment, the temperature of the water, or alternatively of the mixed water and ground laundry active, and the residence time are sufficient to melt and/or fully dissolve the ground laundry active.

In one embodiment, hydration comprises a continuous MHD wherein the ground laundry active and water are combined and contacted with a low residence time. In one embodiment the total time to combine the ground laundry active and water and the residence time is from about 0.0001 sec to about 1 min, alternatively from about 0.01 sec to about 2 sec. In one embodiment hydration comprises the use of a continuous MHD and batch hydrator. Examples of a continuous MHD is the MHD 2000 manufactured by IKA Works, Inc., 2635 North Chase Pkwy. SE, Wilmington, N.C. 28405-7499 USA.

In one embodiment, hydration comprises the use of a high shear mixer. Non-limiting examples of a high shear mixer are the SONOLATOR and GAULIN homogenizer. In one embodiment, hydration comprises an in-line, continuous, high pressure homogenizer, such as a SONOLATOR, that subjects the ground laundry active and water to high pressure, extreme acceleration and ultrasonic cavitation by forcing the material through an orifice.

Optionally, heat may be applied to the hydrator before and/or during hydration.

In one embodiment, the temperature of the water and/or the residence time may depend on the ratio of water to the amount of ground laundry active being hydrated.

In one embodiment, the ratio by weight of water to the weight of ground laundry active is from about 1 to about 25, alternatively about 3 to about 6, alternatively about 3.5 to about 4.5. In one embodiment, the ratio by weight of water to the weight of ground laundry active is such that the viscosity of the mixture is less than about 100,000 cp, alternatively less than about 10,000 cp, alternatively less than about 5,000 cp, alternatively less than about 1,000 cp, wherein the viscosity is measured at the process temperature, typically from about 55° C. to about 70° C., and a shear speed from about 1 sec to about 10 sec, using a Paar Physica Rheolab MC 1 Portable rheometer with a Z3 cup and bob attachment manufactured by Anton-Paar, Anton-Paar-Str. 20, A-8054 Graz, Austria.

Additional processing steps following hydration are known in the art and can be used to reconstitute the hydrated laundry active into a finished laundry active for sale to a customer.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

It should be understood that every maximum numerical limitation given throughout this specification includes every lower numerical limitation, as if such lower numerical limitations were expressly written herein. Every minimum numerical limitation given throughout this specification includes every higher numerical limitation, as if such higher numerical limitations were expressly written herein. Every numerical range given throughout this specification includes every narrower numerical range that falls within such broader numerical range, as if such narrower numerical ranges were all expressly written herein.

All parts, ratios, and percentages herein, in the Specification, Examples, and Claims, are by weight and all numerical limits are used with the normal degree of accuracy afforded by the art, unless otherwise specified.

As used herein, "essentially free of" is defined as containing only trace amounts. In one embodiment, this amount is less than about 1%, alternatively less than about 0.5%, alternatively less than about 0.1%, alternatively less than about 0.01%.

As used herein, "and/or" is defined as any combination of one or more elements of the specified set. For example, A and/or B is to be interpreted as either A, B, or A and B.

Except as otherwise noted, the articles "a," "an," and "the" mean "one or more."

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

All documents cited in the Detailed Description of the Invention are, in relevant part, incorporated herein by reference; the citation of any document is not to be construed as an admission that it is prior art with respect to the present invention. To the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A method of making a fabric softener comprising the steps:

a) casting a laundry active in a solid form, wherein the cast solid form has a mass from about 8 kg to about 80 kg, and wherein the laundry active comprises a cationic fabric softening active;

b) grinding the cast sold form into a ground laundry active; and c) hydrating the ground laundry active with water in a hydrator.

2. The method of claim 1, wherein the ratio by weight of water to the weight of the ground laundry active is from about 3 to about 6.

3. The method of claim 2, wherein the water for hydrating the ground laundry active is at a temperature from about 80° C. to about 95° C.

4. The method of claim 1, wherein the mass of the cast solid form is from about 15 kg to about 35 kg.

5. The method of claim 4, wherein the cast solid form comprises from about 5 wt % to about 20 wt % of hard tallow.

6. The method of claim 1, wherein the step of hydrating further comprises the step of subjecting the ground laundry active to ultrasonic cavitation.

7. The method of claim 6, wherein the cationic fabric softening active is a quaternary ammonium compound.

8. The method of claim 1, wherein the cationic fabric softening active is a quaternary ammonium compound.

9. The method of claim 3, wherein the step of hydrating further comprises the step of subjecting the ground laundry active to ultrasonic cavitation; and wherein the cationic fabric softening active is a quaternary ammonium compound.

* * * * *